United States Patent [19]

Brandes

[11] Patent Number: 4,885,854

[45] Date of Patent: Dec. 12, 1989

[54] PICTURE FRAME FORMED FROM UNITARY BLANK

[75] Inventor: Hal M. Brandes, Mill Valley, Calif.

[73] Assignee: Picturemates Corporation, San Francisco, Calif.

[21] Appl. No.: 524,168

[22] Filed: Aug. 12, 1983

[51] Int. Cl.[4] ..... A47G 1/06; G09F 1/12

[52] U.S. Cl. ..... 40/152.1; 40/124.1

[58] Field of Search ..... 40/152.1, 152, 156, 40/124.1

[56] References Cited

U.S. PATENT DOCUMENTS

| | | | |
|---|---|---|---|
| 1,521,940 | 1/1925 | Gilmore | 40/124.1 |
| 2,160,724 | 5/1939 | Fletcher | 40/124.1 |
| 2,845,733 | 8/1958 | Fox | 40/152.1 |

*Primary Examiner*—Gene Mancene
*Assistant Examiner*—J. Hakomaki
*Attorney, Agent, or Firm*—Epstein, Edell & Retzer

[57] ABSTRACT

A picture frame is formed by folding a unitary blank along pre-formed fold lines and includes front, intermediate and rear panels. The intermediate panel is folded behind the front panel, which is apertured, to form a three-sided pocket for retaining a picture to be viewed through the aperture. A pocket seal is effected by the rear panel which is folded over the intermediate panel and is also folded out of plane to present a convex rear frame surface. A resulting curved lower edge of the rear panel cooperates with the lower edge joining the front and intermediate panels to provide a stable support for the frame. The front panel is provided with flaps which overlie the intermediate panel to close the sides of the pocket. Slots are defined in the flaps to receive tabs on the rear panel to secure the rear panel in its folded configuration.

20 Claims, 1 Drawing Sheet

PICTURE FRAME FORMED FROM UNITARY BLANK

BACKGROUND OF THE INVENTION

1. Technical Field

The present invention relates to picture frames and, more particularly, to picture frames formed from a unitary blank of cardboard, paper board, plastic or the like.

2. Discussion of the Prior Art

Inexpensive picture frames made from paper board, or the like, are well-known. Such frames may be inexpensively fabricated from a unitary blank of paper board by folding the blank along fold or score lines which are pre-formed in the blank. Such frames generally suffer from a number of disadvantages, one of which concerns poor retention of a picture placed in the frame. Specifically, such frames are generally open at their bottom edges to permit insertion of a picture which is intended to be frictionally engaged between front and rear frame panels. Unfortunately, such engagement is not reliable and pictures quite often fall out through the open bottom edge of the frame. Another disadvantage of such prior art frames relates to the inability to reliably maintain the frame upright when it is placed on a table or other support surface. The support arrangement for such frames generally includes a support tab which is partially cut out of the rear panel and is foldable such that it projects out of the plane of that panel. The lower edge of the support tab cooperates with the bottom edge of the rear panel to provide support edges for the frame. The support tab, however, is often inadvertently deformed, sometimes during folding of the tab out of the rear panel plane, and other times during use, resulting in a tab structure which is not sufficiently rigid to support the frame.

Other attempts to provide inexpensive paper board frames have at least partially solved one or the other of the aforementioned problems; however, no single frame has been provided which satisfactorily solves both problems while remaining inexpensive to fabricate.

OBJECTS AND SUMMARY OF THE INVENTION

It is therefore an object of the present invention to provide a picture frame which is inexpensive to fabricate, reliably holds pictures placed therein, and can be stably supported on a flat surface.

It is another object of the present invention to provide a picture frame made of a unitary blank of paper board, or the like, which can be folded along preformed fold lines to provide a pocket which retains an inserted picture and wherein the pocket structure is maintained against inadvertent opening.

A further object of the present invention is to provide a unitary blank of paper board, or the like, which can be readily folded along pre-formed fold lines to form a picture frame which reliably retains pictures inserted therein and which is capable of being reliably supported on a flat surface.

In accordance with the present invention, a picture frame is formed from a unitary blank having three major sections joined by fold lines. A first section, corresponding to an intermediate panel in the assembled frame, is folded over on to a second apertured section which corresponds to the frame front panel. The third section, corresponding to the rear panel of the frame, folds over behind the intermediate panel and includes tabs which engage slotted flaps on the front panel to secure the frame together. The rear panel is folded along a pair of lines to form a concave outer surface and a resulting curved bottom edge. The curved bottom edge of the rear panel cooperates with the fold line between the intermediate and front panels to define a stable support edge arrangement The fold between the intermediate and front panels also seals the bottom of a pocket formed by those two panels in order to retain a picture inserted in the pocket. The slotted flaps on the front panel extend over the intermediate panel to close off the sides of the pocket.

BRIEF DESCRIPTION OF THE DRAWINGS

These and other objects, features, and many of the attendant advantages of the present invention will be better understood upon a reading of the following detailed description when considered in connection with the accompanying drawings wherein like parts in each of the several figures are identified by the same reference numerals, and wherein.

DESCRIPTION OF THE PREFERRED EMBODIMENT

Figures 1, 2, 3, 4, 5, 6, 7, 8, 9:
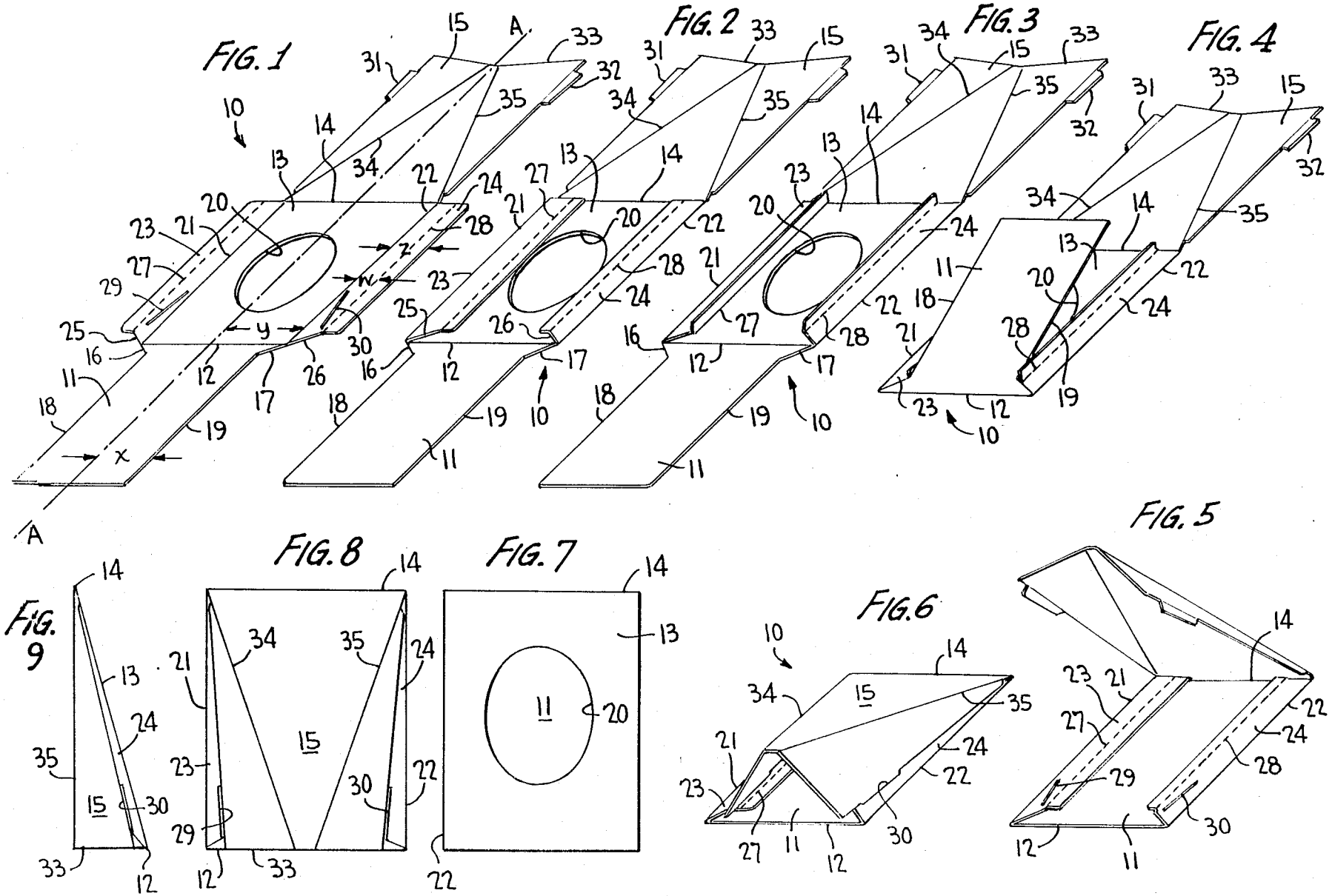
FIG. 1 is a view in perspective of a unitary blank of the present invention which can be folded to form the picture frame of the present invention.
FIGS. 2, 3, 4, 5 and 6 are views in perspective illustrating respective folding steps performed on the blank of FIG. 1 in order to form the picture frame of the present invention.
FIG. 7 is a front view in elevation of the picture frame formed from the blank of FIG. 1 in accordance with the present invention.
FIG. 8 is a rear view in elevation of the picture frame of FIG. 7.
FIG. 9 is a side view in elevation of the picture frame of FIG. 7.

Referring specifically to FIG. 1 of the accompanying drawings, a unitary blank 10 of paper board, cardboard or foldable plastic material is illustrated as including three distinct sections 11, 13 and 15. In the preferred embodiment sections 11, 13 and 15 are disposed at successive longitudinal locations along a central longitudinal axis A—A wherein the central section 13 is separated from the two end sections 11 and 15 by respective transversely-extending fold lines 12 and 14. In this embodiment, the entire blank 10 is transversely symmetrical about axis A—A in each of the sections. It should be understood, however, that such symmetry is a desired but not a necessary feature of the invention. In addition, the arrangement of sections 11, 13 and 15 in longitudinal succession is also a preferred embodiment of the invention but it will be noted that sections 11 and 15 may be disposed at adjacent rather than opposite ends of middle section 13.

Blank section 11 includes a relatively short portion defined between transverse sides or edges 16 and 17 which converge generally toward one another from opposite ends of fold line 12. The remainder of section 11 extends remotely from fold line 12 and has a generally rectangular configuration. The width or transverse dimension of the rectangular portion of section 11 is 2x, so that the spacing between axis A—A and each longitudinally-extending edge 18 and 19 is x.

The middle section 13 has a picture-viewing aperture 20 defined therein. Aperture 20, in the preferred embodiment, has a generally oval configuration, although this is not a limiting feature of the present invention. A pair of longitudinally-extending fold lines 21 and 22 are defined on opposite sides and in spaced relation with respect to aperture 20. Fold lines 20 and 22 are mutually parallel and extend perpendicular to fold line 12 from opposite ends of that fold line. The transversely outer portion of section 13 beyond fold lines 21 and 22 correspond to respective flaps 23 and 24 which terminate at their transversely distal ends in longitudinally-extending edges. The sides of flaps 23 and 24 which are proximate section 11 of the blank include respective first portions 25 and 26 which are straight line continuations of the edges 16 and 17, respectively, of the short portion of section 11 of the blank. Flaps 23 and 24 are otherwise generally rectangular in configuration. Each flap includes a score line 27, 28 extending longitudinally along the flap in parallel relation to fold lines 21 and 22. A pair of slots 29 and 30 are cut in respective flaps 23 and 24 between the score lines 27, 28 and the fold lines 21, 22. Slots 29 and 23 are skewed slightly from longitudinal orientation such that they diverge generally toward one another in a direction toward fold line 14. The transverse dimension between fold lines 21 and 22 is 2y so that, as illustrated in FIG. 1, the spacing between axis A—A and each fold line 21 and 22 is y. The spacing between each fold line 21, 22 and its adjacent score line 27, 28 is designated w, whereas the transverse distance from axis A—A to the outer edge of each of the flaps 23, 24 is designated z. In the preferred embodiment, the distance x is provided so as to be greater than the distance y-z. Under such circumstances, and as will be appreciated from the description below relating to FIGS. 2-6, when section 11 is folded over onto section 13 along fold line 12, flaps 23 and 24 can be folded along lines 21 and 22 respectively, to overlap a portion of section 11. In addition, in accordance with the preferred embodiment of the invention, the distance x on section 11 is less than y-w. This places the score lines 27 and 28 in a position wherein they do not overlap the section 11.

Section 15, which extends outwardly from fold line 14, is of generally rectangular configuration having a width substantially equal to 2w, or the width between the fold lines 21 and 22 in section 13. A pair of tabs 31 and 32 project transversely outwardly from opposite longitudinally-extending sides of section 15 at locations proximate the remote or distal edge 33 of section 15. Tabs 31 and 32 are adapted to be inserted into slots 29 and 30 in the manner described herein below, and consequently are longitudinally positioned so as to generally align with the slots when section 15 is folded over section 13 along fold line 14. A pair of fold lines 34 and 35 are defined in section 15 and intersect distal edge 33 at spaced locations. Fold lines 34 and 35 diverge from distal edge 33 toward opposite ends of fold line 14. It is noted that the longitudinally-extending sides of section 15 terminate prior to intersecting fold line 14 so that the actual joinder between sections 15 and 13 includes edges corresponding to extensions of the fold lines 34 and 35.

In assembling the picture frame of the present invention from the blank illustrated in FIG. 1, it should be noted that the surface of section 13 illustrated in FIG. 1 corresponds to the rear surface of the front panel of the finally assembled picture frame. The first step in the assembly is to fold flaps 23 and 24 along fold lines 21 and 22, respectively, over onto the rear surface of the front panel or blank section 13, as illustrated in FIG. 2. The flaps 23 and 24 need not be pressed onto the section 13 at this time, as long as the fold is generally made. As illustrated in FIG. 3, the flaps are then folded along score lines 27 and 28 so that the edges of the flaps extend away from the front panel or blank section 13. Blank section 11, which serves as an intermediate panel in the assembled frame, is then folded along fold line 12 on to the rear surface of front panel 13 in the manner illustrated in FIG. 4. Since the dimension x, corresponding to one-half the width of intermediate panel 11, is less than y-w, the intermediate panel readily fits between the up-folded edges of the flaps 23 and 24 in order to permit the intermediate panel to be placed adjacent the rear surface of front panel 13. This step is followed by folding the flaps 23 and 24 along score lines 27 and 28 once again, but this time folding the flap extensions generally downward so as to overlap the intermediate panel 11. In other words, since the dimension x is greater than y-z, the flap extensions overlap the intermediate panel. Blank section 15, which also corresponds to the rear panel of the assembled picture frame, is then folded along fold lines 34 and 35 such that the rear surface of the rear panel will ultimately be convex. The rear panel 15 is then folded along fold line 14 over the flaps 23 and 24 in the manner illustrated in FIGS. 5 and 6. Tabs 31 and 32 are inserted into slots 29 and 30, respectively to provide the finally assembled picture frame illustrated in FIGS. 6-9.

In the final assembled frame, the intermediate panel 11 defines a pocket between it and the rear surface of front panel 13 in which a picture can be placed by temporarily disconnecting and unfolding the rear panel 15. This pocket is closed at the bottom of the frame by the fold line 12 between front panel 13 and intermediate panel 11. The picture is prevented from falling out from the sides of the frame by the flaps which cover the intermediate panel. The top of the frame is also closed by fold line 14 which joins the front panel 13 and the rear panel 15.

The bottom edge of the front panel, corresponding to fold line 12, serves as one part of the support edge arrangement for the frame. The other part of the support edge arrangement is provided by distal edge 33 of rear panel 15 which is folded into a generally trapezoidal configuration by means of the folds along fold lines 34 and 35. Rear panel 15 is maintained in this folded state, thereby maintaining the trapezoidal edge configuration, by the engagement of tab members 31 and 32 in respect to the slots 29 and 30.

It should be noted that the intermediate panel 11 need not be rectangular in cross-section as illustrated in the preferred embodiment. It is only necessary that the intermediate panel 11 provide a pocket with a closed bottom edge in conjunction with the rear surface of front panel 13 for receiving a picture to be viewed through viewing aperture 20. Another desirable feature of the invention is that flaps 23 and 24 be configured to overlie the intermediate panel 11 in the assembled frame so that the sides of the pocket are closed. It is also a desirable feature of the invention that the engagement of the rear panel 15 to the flaps 23, 24 (such as by tabs 31, 32 engaging slots 29, 30) be such that the rear panel 15 is maintained folded along fold lines 34 and 35 by such engagement, thereby assuring the curved configuration of lower edge 33 for support purposes.

From the foregoing description it will be appreciated that the present invention makes available a novel, inexpensive picture frame which is easily put together. The frame is provided with a pocket which reliably retains any picture inserted therein. Moreover, the bottom edge arrangement of the frame provides a stable support which maintains the frame in an upright position.

Having described a particular embodiment of a new and improved picture frame and unitary forming blank constructed in accordance with the present invention, it is believed that other modifications, variations and changes will be suggested to those skilled in the art in light of the above disclosure. It is therefore to be understood that all such variations, modifications and changes are believed to fall within the scope of the present invention as defined by the appended claims.

What is claimed is:

1. A picture frame formed from a unitary blank comprising:

a front panel section having first and second edges corresponding to first and second fold lines, respectively, defined in said unitary blank, front and rear surfaces, and a viewing aperture defined therethrough to permit viewing from in front of said front surface of a picture disposed against said rear surface;

an intermediate panel section secured to said first edge of said front panel section and folded along said first fold line through substantially 180° into adjacency with the rear surface of said front panel to overlie at least a portion of said viewing aperture, said intermediate panel section having a smaller area than said front panel section to thereby expose a portion of the rear surface of the front panel section;

a rear panel section having inner and outer surfaces a transversely-extending support edge and first and second longitudinally-extending edges, said rear panel section being secured to said second edge of said front panel section and folded along said second fold line behind both said front panel section and said intermediate panel section such that the intermediate panel section is disposed between the rear surface of the front panel section and the inner surface of the rear panel-section, and such that said support edge is disposed proximate said first edge, said rear panel section having at least a third fold line defined therein and intersecting said support edge; and support means for selectively attaching and detaching said first and second longitudinally-extending edges of said rear panel to said portion of the rear surface of said front panel section when said rear panel section is folded along said third fold line to render the outer surface of said rear panel section generally convex, to thereby permit said picture frame to be supported on said first and support edges in an upright position.

2. The picture frame according to claim 1 wherein said rear panel section includes a fourth fold line defined therein and along which said rear panel section is folded, said third and fourth fold lines intersection said support edge and diverging therefrom generally toward opposite ends of said second edge of said front panel section.

3. The picture frame according to claim 1 wherein said first and second edges are opposite edges of said front panel section and wherein said support means comprises:

first and second flap members extending from opposite sides of said front panel section, each flap member having a slot defined therein; and first and second tab members extending from said first and second longitudinally-extending edges, respectively, of said rear panel section and adapted to be received in the slots in said first and second flap members, respectively.

4. The picture frame according to claim 3 wherein the spacing between the slots in said first and second flap members is less than the spacing between outer extremities of said first and second tab members.

5. The picture frame according to claim 4 wherein the spacing between the slots in said first and second flap members is less than the spacing between closest portions of said first and second tab members prior to folding said rear panel section along said third fold line.

6. The picture frame according to claim 3 wherein said first and second flap members are folded over onto the rear surface of the front panel section in front of the rear panel section to overlie a portion of the folded intermediate panel section.

7. The picture frame according to claim 6 wherein said first and second flap members are each additionally folded along respective additional fold lines which extend alongside edges of the folded intermediate panel section.

8. An article of manufacture in the form of a unitary blank adapted to be folded to form a picture frame, said article comprising:

an elongated panel having first, second and third sections successively defined therein, said second section abutting said first and third sections at respective first and second transversely-extending parallel fold lines;

said first section having a first relatively short portion abutting said first fold line and having sides which diverge toward said first fold line, and a second relatively long portion of generally rectangular configuration and predetermined width;

said third section having a distal edge opposite said second fold line and a generally rectangular configuration with a width greater than said predetermined width, third and fourth fold lines intersecting said distal edge and diverging therefrom generally toward opposite ends of said second fold line, and first and second tabs extending transversely from opposite longitudinally-extending edges of said third section at a location closer to said distal edge than to said second fold line; and said second section having an aperture defined therein and first and second side flaps demarked by fifth and sixth longitudinally-extending parallel fold lines;

wherein said elongated panel has a central longitudinal axis about which said panel is transversely symmetrical in all of said first, second and third sections, wherein the second relatively long portion of said first section has generally longitudinally-extending sides spaced a distance x from said axis, wherein said fifth and sixth fold lines are each spaced a distance y from said axis, wherein in said side flaps each have transverse width z, wherein y is greater than z and wherein x is greater than y–z.

9. The article of manufacture according to claim 8 wherein said flaps include respective longitudinally-extending score lines disposed at a distance w from said fifth and sixth fold lines, respectively, and wherein x is less than y–w.

10. The article of manufacture according to claim 9 further comprising first and second slots defined in said first and second side flaps, respectively, each of said slots being at least commensurate in length with said first and second tabs in said third panel section.

11. The article of manufacture according to claim 10 wherein said aperture in said first section has a generally oval shape.

12. A method of fabricating a picture frame from a unitary blank of paper board material, or the like, said method comprising the steps of:

folding an intermediate panel section of said unitary blank over onto a rear surface of a front panel section which is apertured to form a pocket for a picture inserted between the intermediate and front panel sections;

folding a pair of flaps over onto opposite sides of the intermediate panel to close off said pocket at said opposite sides;

folding a rear panel section so as to provide a convex outer frame surface and a curved lower edge of said rear panel section;

folding said folded rear panel section over onto said pair of flaps and said intermediate panel; and engaging said rear panel surface to said pair of flaps such that the engagement maintains the convex configuration of the rear surface of the rear panel section.

13. The picture frame according to claim 7 wherein said rear panel section includes fourth fold line defined therein along which said rear panel section is folded, said third and fourth fold lines intersecting said support edge and diverging therefrom generally toward opposite ends of said second edge of said front panel section.

14. The picture frame according to claim 1 wherein said first and second edges are opposite edges of said front panel section and wherein said support means comprises:

first and second flap members extending from opposite sides of said front panel section, each flap member having respective tab-receiving portions configured therein; and first and second tab members extending from said first and second longitudinally-extending edges, respectively, of said rear panel section and adapted to be received in the tab-receiving portions in said first and second flap members, respectively.

15. The picture frame according to claim 14 wherein the spacing between the tab-receiving portions in said first and second flap members is less than the spacing between outer extremities of said first and second tab members.

16. The picture frame according to claim 15 wherein the spacing between the tab-receiving portions in said first and second flap members is less than the spacing between closest portions of said first and second tab members prior to folding said rear panel section along third fold line.

17. The picture frame according to claim 14 wherein said first and second flap members are folded over onto the rear surface of the front panel section between said rear surface and the rear panel section.

18. The picture frame according to claim 17 wherein said first and second flap members are each folded along lines which extending parallel to said first and second longitudinally-extending edges.

19. An article of manufacture in the form of a unitary blank adapted to be folded to form a picture frame, said article comprising:

an elongated panel having first, second and third sections successively defined therein, said second section abutting said first and third sections at respective first and second transversely-extending parallel fold lines;

said first section having a first relatively short portion abutting said first fold line and having sides which diverge toward said first fold line, and a second relatively long portion of generally rectangular configuration and predetermined width;

said third section having a distal edge opposite said second fold line and a generally rectangular configuration with a width greater than said predetermined width, third and fourth fold lines intersection said distal edge and diverging therefrom generally toward opposite ends of said second fold line, and first and second tabs extending transversely from opposite longitudinally-extending edges of said third section at a location closer to said distal edge than to said second fold line; and said second section having an aperture defined therein and first and second retainer means disposed on opposite transverse sides of said aperture for selectively receiving and holding respective portions of said third section against said second section.

20. A method of fabricating a picture frame from a unitary blank of paper board material, or the like, said method comprising the steps of:

folding an intermediate panel section of said unitary blank over onto a rear surface of a front panel section which is apertured to form a pocket for a picture inserted between the intermediate and front panel sections;

engaging said intermediate panel against said front panel;

folding a rear panel section so as to provide a convex outer frame surface and a curved lower edge of said rear panel section;

folding said rear panel section over and onto said intermediate panel to form three successive layers of said front, intermediate and rear panels, respectively; and engaging said rear panel to said front panel such that the engagement maintains the convex configuration of the rear surface of the outer frame panel section.

* * * * *